US005288157A

United States Patent [19]

Tanaka

[11] Patent Number: 5,288,157

[45] Date of Patent: Feb. 22, 1994

[54] PRINTING CONTROL SYSTEM HAVING MEANS TO CORRECT FLIGHT TIME

[75] Inventor: Hirotomo Tanaka, Suwa, Japan

[73] Assignee: Seiko Epson Corporation, Tokyo, Japan

[21] Appl. No.: 778,908

[22] PCT Filed: May 15, 1991

[86] PCT No.: PCT/JP91/00642

§ 371 Date: Jan. 9, 1992

§ 102(e) Date: Jan. 9, 1992

[87] PCT Pub. No.: WO91/17892

PCT Pub. Date: Nov. 28, 1991

[30] Foreign Application Priority Data

May 15, 1990 [JP] Japan ..... 2-124774

[51] Int. Cl.[5] ..... B41J 2/30

[52] U.S. Cl. ..... 400/279; 400/124

[58] Field of Search ..... 400/319, 322, 279, 323, 400/577, 124

[56] References Cited

U.S. PATENT DOCUMENTS

| | | | |
|---|---|---|---|
| 4,533,268 | 8/1985 | Sanders, Jr. | 400/322 |
| 4,733,981 | 3/1988 | Takeuchi | 400/279 |
| 4,832,518 | 5/1989 | Moriyama | 400/279 |
| 4,844,635 | 7/1989 | Malkemes | 400/279 |
| 4,869,609 | 9/1989 | Iwata | 400/279 |
| 4,869,610 | 9/1989 | Nishizawa et al. | 400/279 |
| 4,948,279 | 8/1990 | Ikoma et al. | 400/279 |
| 5,007,751 | 4/1991 | Yamakawa | 400/279 |
| 5,116,150 | 5/1992 | Courtney | 400/322 |

FOREIGN PATENT DOCUMENTS

| | | |
|---|---|---|
| 0157048 | 10/1985 | European Pat. Off. . |
| 63-57269 | 3/1988 | Japan . |
| 1-023428 | 9/1989 | Japan . |
| 1-291970 | 11/1989 | Japan . |
| 2-70470 | 3/1990 | Japan . |
| 2-261678 | 10/1990 | Japan . |

OTHER PUBLICATIONS

Patent Abstracts of Japan, vol. 13, No. 560 (M-906)(3908) Dec. 13, 1989, JP1-234280.

*Primary Examiner*—J. Reed Fisher
*Assistant Examiner*—John S. Hilten
*Attorney, Agent, or Firm*—Ladas & Parry

[57] ABSTRACT

A printing control system A in which a printing head 7 is moved by a belt 10 coupled to a carriage drive motor 4, and a printing command signal 301 generated in response to an encoder pulse signal 501 synchronized with the revolution of the carriage drive motor 4 is applied to the printing head 7, the system A comprises a unit 1 for detecting the moving speed of the printing head 7; and units 2 and 3 for correcting timing at which the printing command signal 301 is generated, in association with both the belt expansion and contraction rate and flight time at the detected moving speed. The control system A further comprises a unit 15 for discriminating whether the printing head 7 is being accelerated or decelerated. The results discriminated by this unit 15 are given to the correcting units 2 and 3 so that the timing rate differs according to the acceleration and deceleration. In the above timing correction, a method is adopted such that the generation timing of the printing command signal 301 is delayed from the encoder pulse signal 501, irrespective of the acceleration and deceleration, by introducing the offset time having inversely proportional relationship with respect to the moving speed of the printing head 7. Further, there is incorporated therewith a unit 14 for controlling the carriage drive motor 4 in such a way that the acceleration of the printing head 7 can be changed smoothly.

2 Claims, 9 Drawing Sheets

PRINTING CONTROL SYSTEM HAVING MEANS TO CORRECT FLIGHT TIME

TECHNICAL FIELD

The present invention relates to a printing control system suitable for a printer such as a serial-dot printer by which printing operation is effected by shifting a printing head.

BACKGROUND ART

FIG. 1 shows a carriage driving mechanism for an ordinary serial-dot printer, in which printing to a printing medium 13 (e.g. paper) is made by converting the rotational motion of a carriage drive motor 4 into a linear motion via a pulling member (e.g. belt) 10 and pulleys 11 so that a carriage 12 for mounting a printing head 7 can travel at a predetermined speed. Further, the positional control of the carriage 12, that is, the printing position control is effected on the basis of the output pulse of an encoder 5 mounted on the carriage drive motor 4.

FIG. 2 shows a driving pattern of the carriage drive motor 4 required when printing data for one line is printed.

In general, the printing operation is effected when the carriage 12 travels at a target constant speed. However, it is possible to realize a high speed printing if the printing operation is effected when the carriage 12 is being accelerated from a standstill to a constant speed or when being decelerated from a constant speed to a standstill.

In the serial-dot printer such as a wire dot printer in particular, however, the travel distance of the carriage 12 from when a printing command is given to when the ends of wires reach the printing medium 13 to form dots (referred to as flight time) differs according to the travel speed of the carriage 12, thus resulting in a problem in that dot intervals are not equalized when the printing operation is made under the condition that the travel speed of the carriage 12 is not kept at a constant value.

To overcome this problem, conventionally a delay time is determined according to the flight time and the carriage travel speed, and the printing command is given after the delay time has elapsed for compensation, as disclosed in Japanese Published Unexamined (Kokai) Patent Appli. No. 55-85984.

As another serious problem, however, there exists the influence of expansion and contraction of the pulling member, with the result that the dot intervals will not be equalized when the printing operation is effected during the acceleration or deceleration of the carriage 12.

A belt 10 is typically used as the pulling member, and the belt is usually provided with an elastic component. FIG. 3 is a simplified model view of the carriage drive mechanism, in which (a) shows the status where the carriage is driven in an ideal fashion without influence of elastic component and (b) shows the status where the carriage is accelerated in the arrow direction under influence of elastic component. In the case shown in FIG. 3(*b*), a torque generated by the carriage drive motor 4 is transmitted to the carriage 12 under the condition that the belt is being expanded by $\Delta E$ on the travel direction side (contracted on the opposite side). On the other hand, when decelerated, a torque generated by the carriage motor 4 is transmitted to the carriage 12 under the condition that the belt is being contracted on the travel direction side (expanded on the opposite side). In the description below, the expansion and contraction of the belt 10 are discussed only on the travel direction side.

In FIG. 3, the reference numeral 502 denotes a graduation obtained by converting the encoder pulse generated by the encoder 5 for each constant revolutional angle $\Delta r$ of the carriage drive motor 4 into the travel distance of the carriage 12, in which the rotational angle $\Delta r$ corresponds to the travel stroke $\Delta x$ of the carriage 12. In general, the printing command signals are given on the basis of the rotational angle of the carriage drive motor 4. Therefore, the printing command signals are generated on the assumption that the carriage 12 travels by $\Delta x$ whenever the carriage drive motor 4 rotates through the $\Delta r$. In the conventional method, the correction has been started at this time according to the flight time and the travel speed of the carriage 12.

In the case where the carriage is driven ideally without any elastic component of the belt as shown in FIG. 3(*a*), the carriage 12 travels by a distance $n \times \Delta x$ as illustrated, when the carriage motor 4 rotates by $n \times \Delta r$ and an encoder pulse signal corresponding to the position Pn is generated. In the case where the carriage is driven under the influence of a certain elastic component of the belt as shown in FIG. 3(*b*), when the carriage drive motor 4 rotates by $n \times \Delta r$ during acceleration and a encoder pulse corresponding to the position Pn is generated, since the belt 10 is elongated by $\Delta E$, there exists a problem in that the printed pots are offset by $\Delta E$ from the correct position Pn.

If the rate of the expansion and contraction of the belt is constant, the dot intervals can be kept constant. However, since the expansion and contraction rate varies in such a way that the belt is expanded during acceleration, kept zero at a constant speed, and contracted during deceleration, the dot intervals cannot be kept constant.

As described above, there are two factors which cause the dot intervals to be unequalized when the printing operation is performed during acceleration or deceleration as follows:

* the factor caused by the flight time
* the factor caused by the expansion and contraction of the pulling member Conventionally, however, since the correction has been effected only for that caused by the flight time, there still exists a problem in that the dot intervals cannot be equalized perfectly

DISCLOSURE OF THE INVENTION

Accordingly, the object of the present invention is to provide a printing control system which can equalize dot intervals even if printing operation is effected during acceleration or deceleration of the carriage The printing control system according to the present invention is characterized in that the system is provided with correcting means for correcting the printing operation in accordance with the relationship between the expansion and contraction rate of the pulling member and the travel speed of the printing head, and correcting means for correcting the printing operation in accordance with the relationship between the time from when printing commands are given to when dots are formed on the printing medium and the travel speed of the printing head.

Function

In the construction as described above, when the printing operation is effected during acceleration from a standstill to a constant speed or deceleration from a constant speed to a standstill,

* the expansion and contraction of the pulling member can be cancelled virtually by the correction according to the expansion and contraction rate of the pulling member; and
* the flight time can be changed virtually according to the carriage speed by the correction according to the flight time.

BEST MODE FOR EMBODYING THE INVENTION

Figure 4:
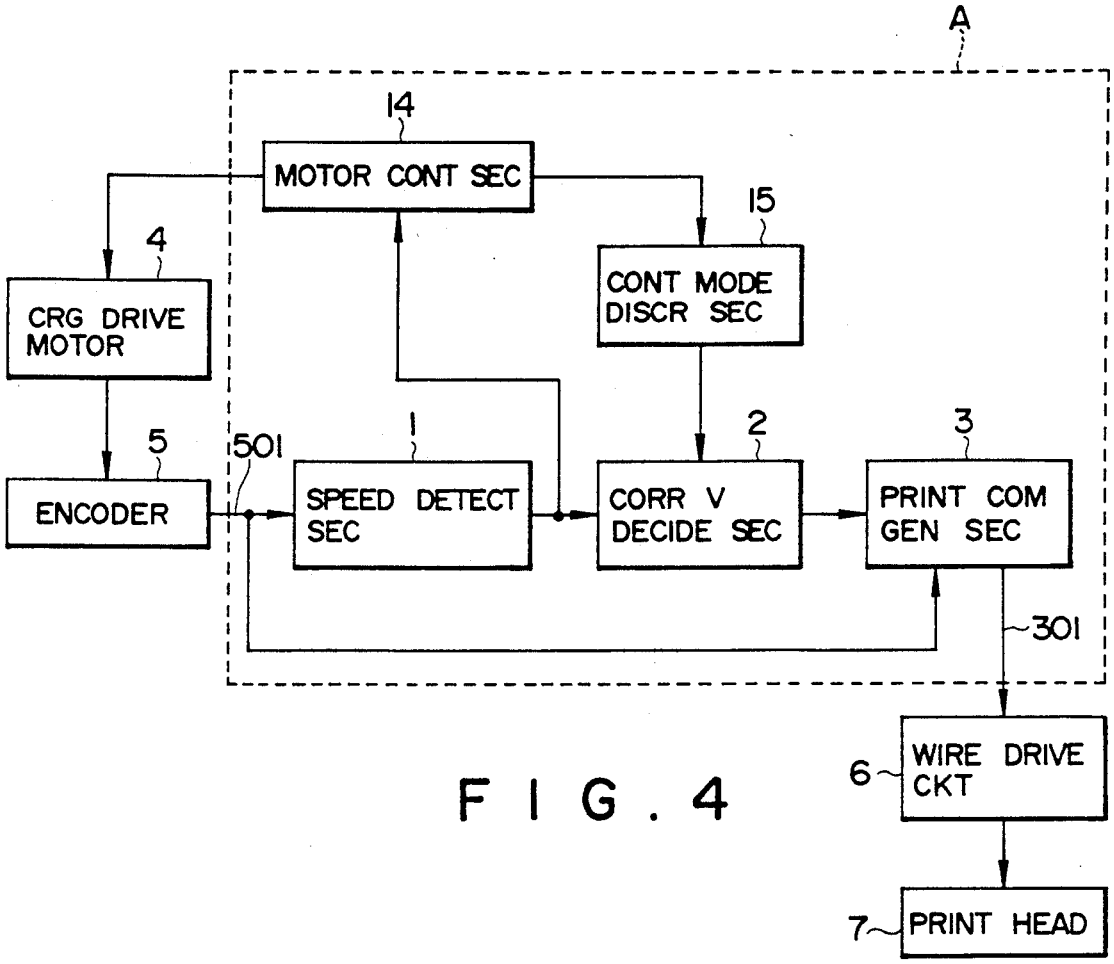
FIG. 4 is a block diagram showing an embodiment of the printing control system according to the present invention.

One embodiment of the present invention will be described hereinbelow in detail with reference to the drawings. FIG. 4 is a block diagram showing a printing control system for a wire dot printer according to the present invention. In FIG. 4, the reference numeral 4 denotes a carriage drive motor. The rotational angle of this carriage drive motor 4 is detected by an encoder 5. The encoder 5 generates an encoder pulse signal 501 and inputs the generated signal to a control section A for each predetermined rotational angle of the carriage drive motor 4. The control section A generates a printing command signal 301 on the basis of the pulse signal 501 from the encoder 5 to actuate a printing head 7 via a wire driving circuit 6 for printing operation.

Figure 5:
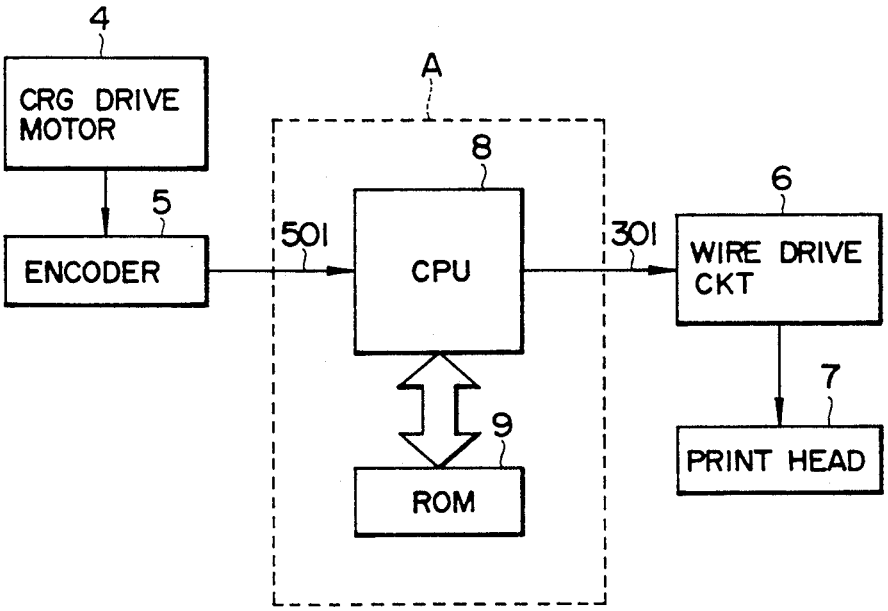
FIG. 5 is a block diagram showing a practical embodiment of the control section A shown in FIG. 4.

FIG. 5 shows a practical example of the control section A, which comprises a CPU 8 and a ROM 9. The CPU 8 executes processing (described later) in accordance with control programs written in the ROM 9. FIG. 4 is a block diagram showing the processing functions of the control section A.

In FIG. 4, a speed detecting section 1 of the control section A measures a period T of the encoder pulse signal 501 from the encoder 5. This period T is a time duration required when the carriage drive motor 4 rotates through a predetermined unit angle. Therefore, the period T corresponds to the rotational speed of the drive motor 4 and further the travel speed V of the carriage. In the ROM 9, a correction value table indicative of the relationship between the period T (i.e. rotational speed) of the encoder pulse signal 501 and the correction value of the printing timing as shown in Table 1 is stored. A correction value deciding section 2 shown in FIG. 4 selects a correction value corresponding to the period T measured by the speed detecting section 1 on the basis of the correction value table. The printing command generating section 3 starts to measure time from when receiving the encoder pulse signal 501 from the encoder 5, and generates the printing command signal 301 when a time corresponding to a correction value given by the correction value deciding section 2 has elapsed.

A motor control section 14 controls the required printing operation of the carriage drive motor 4, which accelerates the carriage drive motor 4 to a target speed, keeps the target speed thereafter, and decelerates the motor 4 so as to be stopped at a predetermined position. A control mode discriminating section 15 discriminates whether the control mode of the carriage drive motor 4 is acceleration, constant speed or deceleration, and transmits a signal to the correction value deciding section 2. The correction value deciding section 2 selects a correction value corresponding to the period T measured by the speed detecting section 1 and the control mode discriminated by the control mode discriminating section 15, on the basis of the correction value table.

The relationship between the rotational speed and the correction value will be explained hereinbelow.

Figure 1:
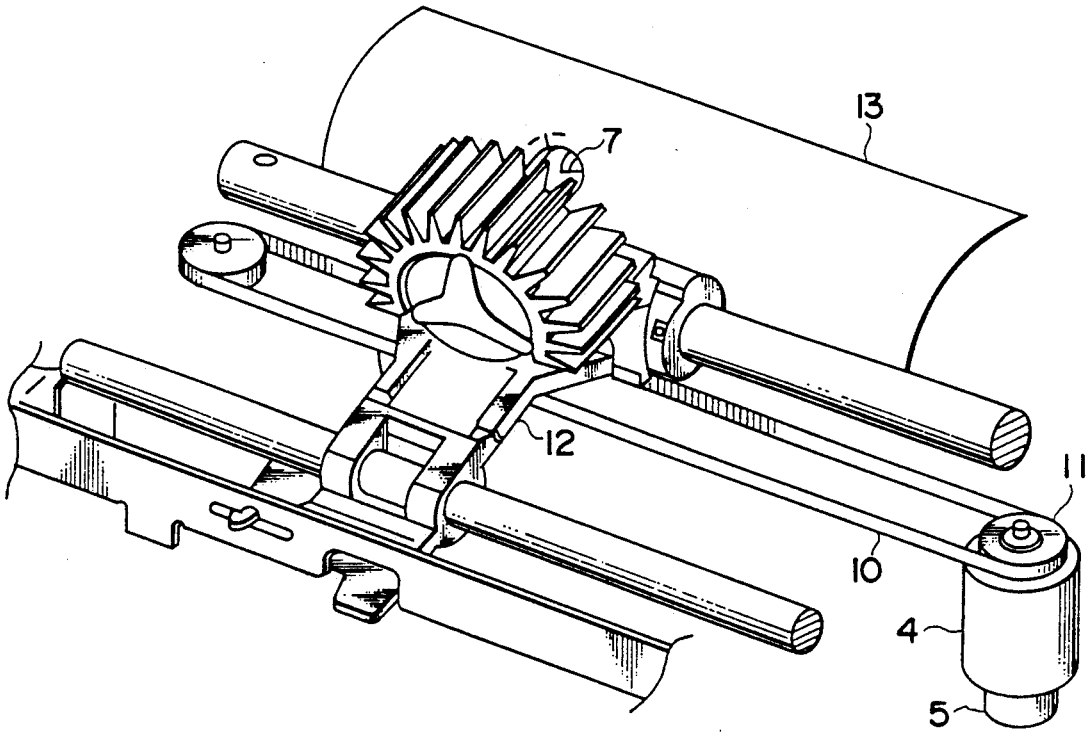
FIG. 1 is a perspective view diagrammatically showing the construction of a carriage drive mechanism of the general serial-dot printer.
Figure 2:
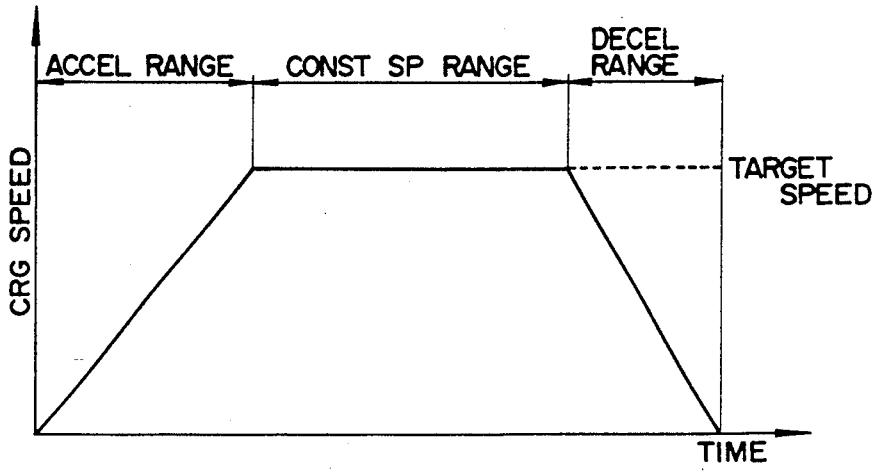
FIG. 2 is a diagram showing a change pattern of the general carriage speed.
Figure 3:
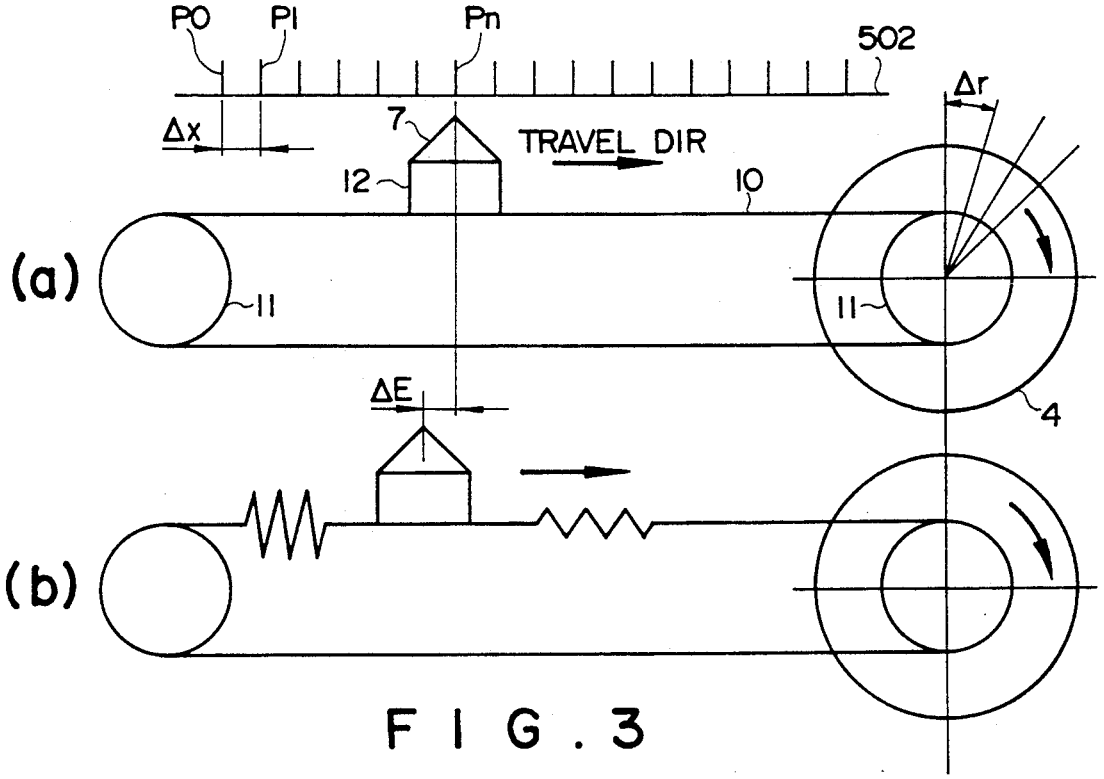
FIG. 3 is an illustration showing a carriage drive system as a model form.

First, the relationship between the correction value for correcting the expansion and contraction of the belt 10 and the rotational speed is as follows: In FIG. 3(*b*), if the travel speed of the carriage 12 during acceleration is designated by V and the elongation of the belt 10 is designated by ΔE, the time Te required to shift the carriage 12 by ΔE can be expressed as $$Te = \Delta E / V$$

This value is a correction value corresponding to the speed V. In other words, a time point delayed by the correction value Te from the detection signal of the up-edge of the encoder pulse signal 501 is a time point at which the carriage 12 reaches a correct printing position. Further, if the belt is contracted during deceleration at the travel speed V of the carriage, since the belt elongation is designated by −ΔE, the time Te can be expressed as $$Te = -\Delta E / V$$

Therefore, in Table 1 the correction value Te is a negative value in the case of deceleration. In other words, a time point a correction value Te before the time point when the up-edge of the encoder pulse signal 501 is detected is a time point at which the carriage 12 reaches a correct printing position.

TABLE 1

| PERIOD T | Te ACCEL | Te DECEL | Tf |
|---|---|---|---|
| t0 | teACC0 | teBRK0 | tf0 |
| t1 | teACC1 | teBRK1 | tf1 |
| t2 | teACC2 | teBRK2 | tf2 |
| . | . | . | . |
| . | . | . | . |
| tn − 1 | teACCn − 1 | teBRKn − 1 | tfn − 1 |
| tn | teACCn | teBRKn | tfn |
| tn + 1 | teACCn + 1 | teBRKn+ 1 | tfn + 1 |
| . | . | . | . |
| . | . | . | . |

On the other hand, the relationship between the correction value for correcting error due to flight time and the rotational speed is as follows: In this embodiment, the position of the printing head 7 obtained when the carriage travels at the maximum speed $V_{max}$ is determined as a reference value, and the correction is made in such a way that the positions of the printing head 7 at the travel speeds other than the maximum speed are arranged at regular intervals beginning from the reference position. For example, in FIG. 6, assuming that the carriage 12 travels from the left to the right being accelerated, the encoder pulse signals 501 are generated at regular distance intervals but time intervals becoming shorter and shorter. At the maximum speed $V_{max}$, where the printing is made by generating the printing command signal 301 at the same time as when the up-edge of the encoder pulse signal 501 is detected, the printing dot position D1 is offset by $S_{max}$ from the up-edge thereof. On the other hand, at the carriage travel speed V (at a certain time point of acceleration), where the printing is made by generating the printing command signal 301 at the same time as when the up-edge of the encoder pulse signal 501 is detected without correction, the printing dot position D2 is offset by $S_V$ from the up-edge position. The correction is made in such a way that the offset $S_V$ at the speed V becomes equal to the offset $S_{max}$ at the maximum speed $V_{max}$; that is, the printing dot position at the speed V is corrected to the position D3 to equalize the respective printing dot intervals.

Figure 6:
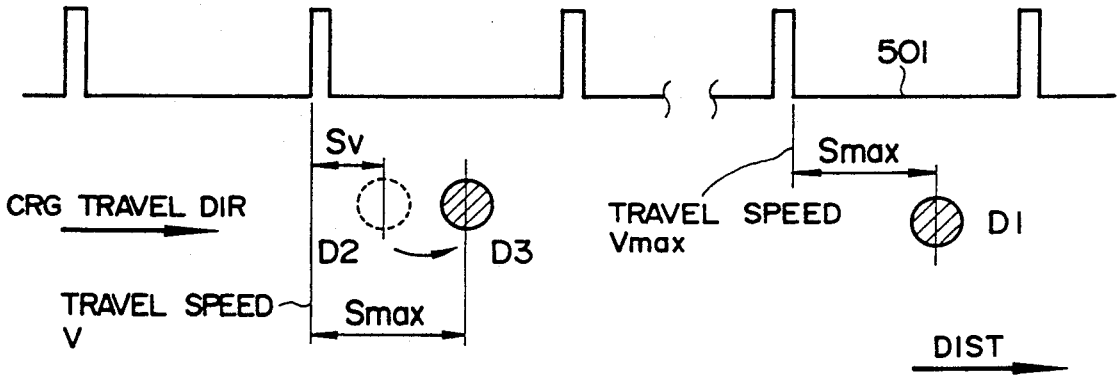
FIG. 6 is a view for assistance in explaining the correction operation related to the flight time in the embodiment shown in FIG. 4.

In FIG. 6, when the printing is made by moving the carriage at the maximum speed $V_{max}$, the offset distance $S_{max}$ from the up-edge of the encoder pulse signal 501 can be expressed as $$S_{max} = V_{max} \times Tfly$$

where Tfly denotes the flight time.

On the other hand, when the printing is made by moving the carriage at the speed V, the printing command signal 301 is generated after the correction time Tf has elapsed from when the up-edge of the encoder pulse signal 501 is detected in order to match the offset $S_V$ with $S_{max}$. Therefore, the following formula Can be established:

$$V_{max} \times Tfly = V \times (Tfly + Tf)$$

Therefore, the correction time Tf can be expressed as $$Tf = Tfly \times (V_{max} - V)/V$$

As described above, both the correction values for correcting error due to the expansion and contraction of the pulling member and for correcting error due to the flight time can be expressed as functions with respect to the travel speed V (the period T of the encoder pulse signal 501) of the carriage 12.

Figure 7:
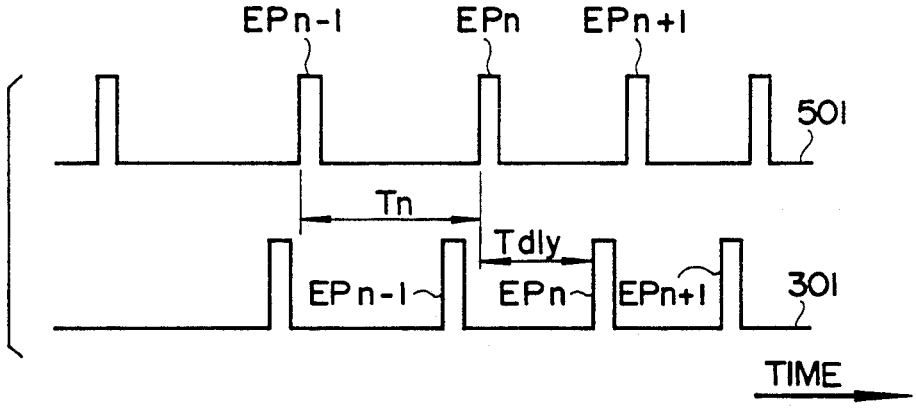
FIG. 7 is a timing chart showing the relationship between the encoder pulse signal and the printing command signal.
Figure 8:
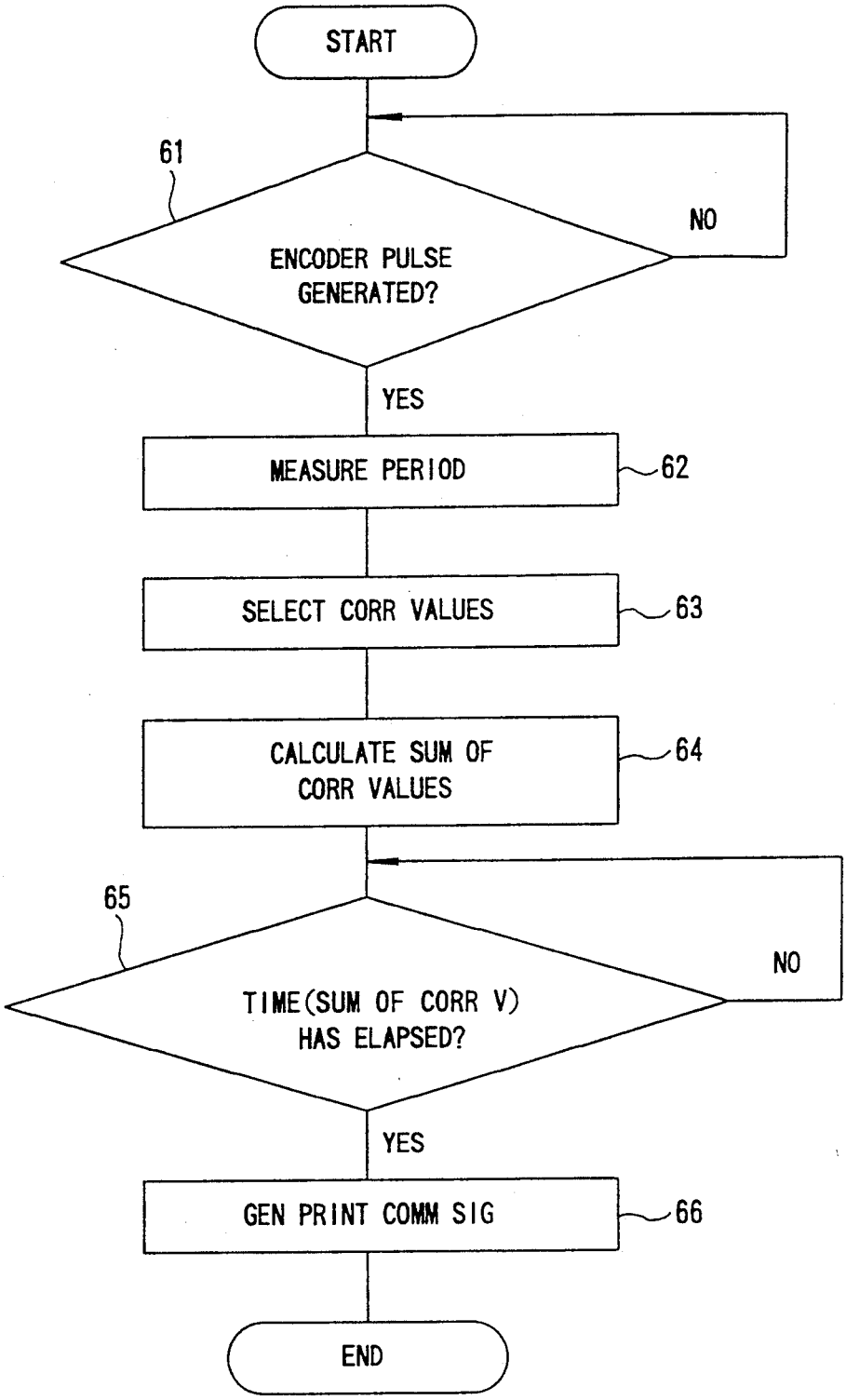
FIG. 8 is a flowchart for assistance in explaining the operation of the embodiment shown in FIG. 4.

The control operation of the control section A will be explained hereinbelow with reference to FIGS. 7 and 8. FIG. 7 shows the encoder pulse signal 501 and the printing command signal 301 along the time axis.

After the generation of the encoder pulse signal EPn−1 and the current encoder pulse signal EPn is measured (in step 62), and correction values Te and Tf corresponding to the period T are selected from the correction value table (corresponding to Table 1) in the ROM 9. If the carriage is being accelerated and the period T is tn as shown in FIG. 7, teACCn is selected as the correction value Te and tfn is selected as Tf (in step 63).

The total correction value Tdly is obtained as $$Tdly = Te + Tf$$

where if the period T is tn,

Tdly=teACCn+tfn (in step 64). After control confirms that the total correction time Tdly has elapsed from when the encoder signal EPn was generated (in step 65), a printing command signal FPn as shown in FIG. 7 is generated (in step 66).

Further, in FIG. 7, the suffixes of the reference numerals of the pulse train represent the order of the pulse generation. However, the suffixes of the symbols of the period T simply represent the correspondence to the correction values, without determining the order of the changes in carriage speed such as acceleration or deceleration.

Figure 9:
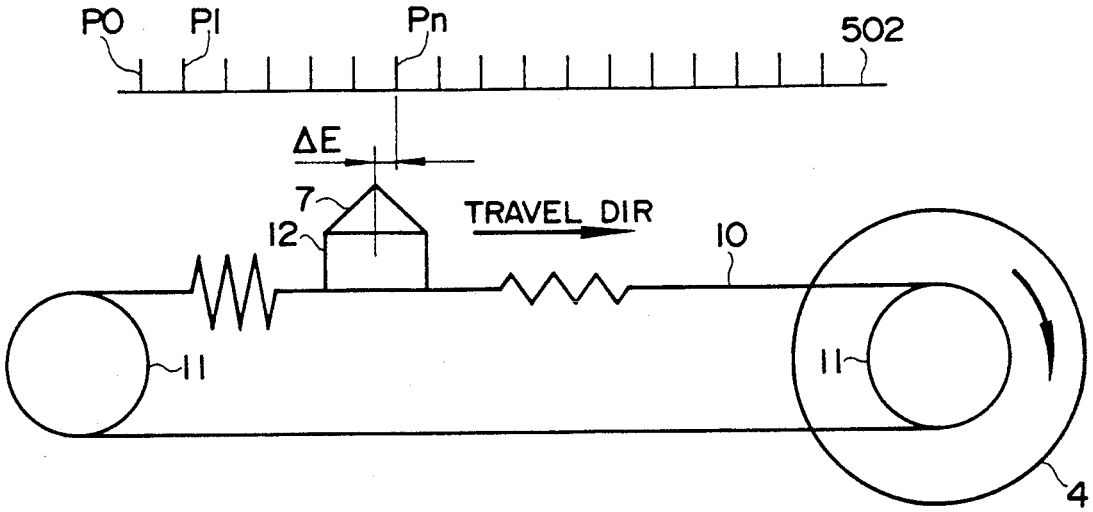
FIG. 9 is an illustration for assistance in explaining the operation of the embodiment shown in FIG. 4.

By the above-mentioned operation, as shown in FIG. 9, after the encoder pulse signal corresponding to the position Pn has been generated, the carriage 12 is shifted by ΔE during the correct time duration Te with respect to the belt expansion and contraction, and reaches the position Pn. Thereafter, the carriage is further moved by a distance corresponding to the speed difference between the maximum speed $V_{max}$ and the current speed V during the correct time duration Tf with respect to the flight time. Immediately after the above carriage shift motion, the printing command signal 301 is generated, so that the intervals of the printed dots are controlled so as to be always equalized. In other words, the expansion and contraction of the pulling member is virtually cancelled by the correction corresponding to the expansion and contraction of the pulling member, and additionally the flight time can be virtually changed according to the speed by the correction corresponding to the flight time.

Figure 10:
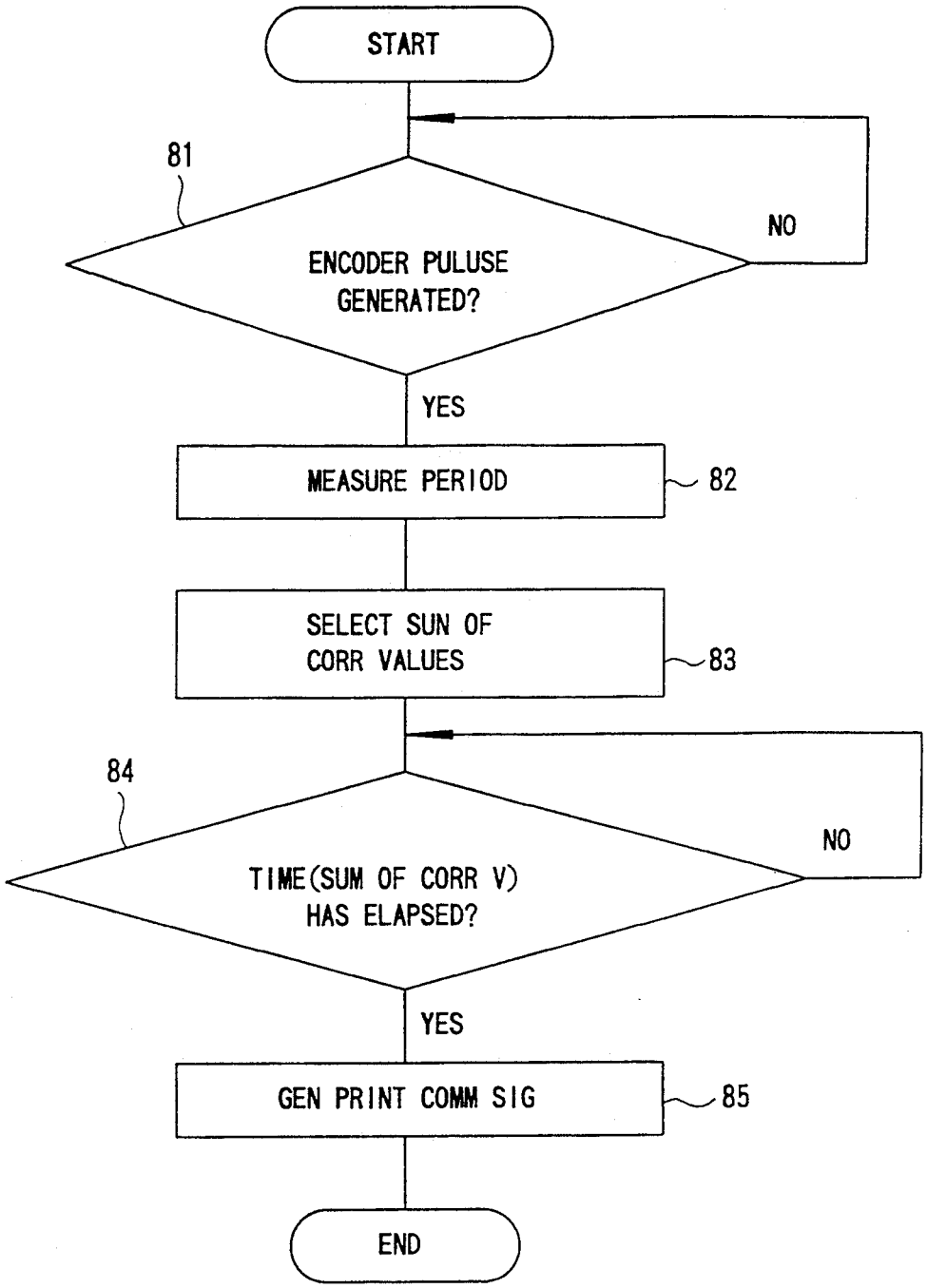
FIG. 10 is a flowchart for assistance in explaining the operation of the second embodiment of the present invention.

A second embodiment of the second embodiment will be explained hereinbelow with reference to FIGS. 7 and 10. FIG. 10 is a flowchart showing the operation of the second embodiment of the present invention. Table 2 is a correction value table used for this second embodiment, in which numerical values obtained by previously adding the correction values for correcting error caused by the expansion and contraction of the belt 10 and that for correcting error caused by the flight time are stored.

TABLE 2

| PERIOD T | Tdly ACCEL | Tdly DECEL |
|---|---|---|
| t0 | tdACC0 | tdBRK0 |
| t1 | tdACC1 | tdBRK1 |
| t2 | tdACC2 | tdBRK2 |
| . | . | . |
| . | . | . |
| tn-1 | tdACCn-1 | tdBRKn-1 |
| tn | tdACCn | tdBRKn |
| tn + 1 | tdACCn + 1 | tdBRKn + 1 |
| . | . | . |
| . | . | . |

In this embodiment, after the generation of the encoder pulse signal EPn has been confirmed (in step 81 in FIG. 10), the period T between the preceding encoder pulse signal EPn−1 and the current encoder pulse signal EPn is measured (in step 82), and a correction value Tdly corresponding to the period T is selected from the Table 2 in the ROM 9. If the period T is tn during acceleration as shown in FIG. 7, tdACCn is selected as the correction value Tdly (in step 83).

If control confirms that the time of the correction value Tdly has elapsed from when the encoder pulse signal EPn was generated (in step 84), the printing command signal FPn is generated (in step 85).

In this embodiment, it is possible to shorten the processing time, because it is unnecessary for the CPU to execute addition processing of the correction value for correcting error due to the expansion and contraction of the belt and that for correcting error due to the flight time. Additionally, since the number of data constituting the table is small, it is possible to reduce the number of bytes required for the ROM 9.

Figure 11:
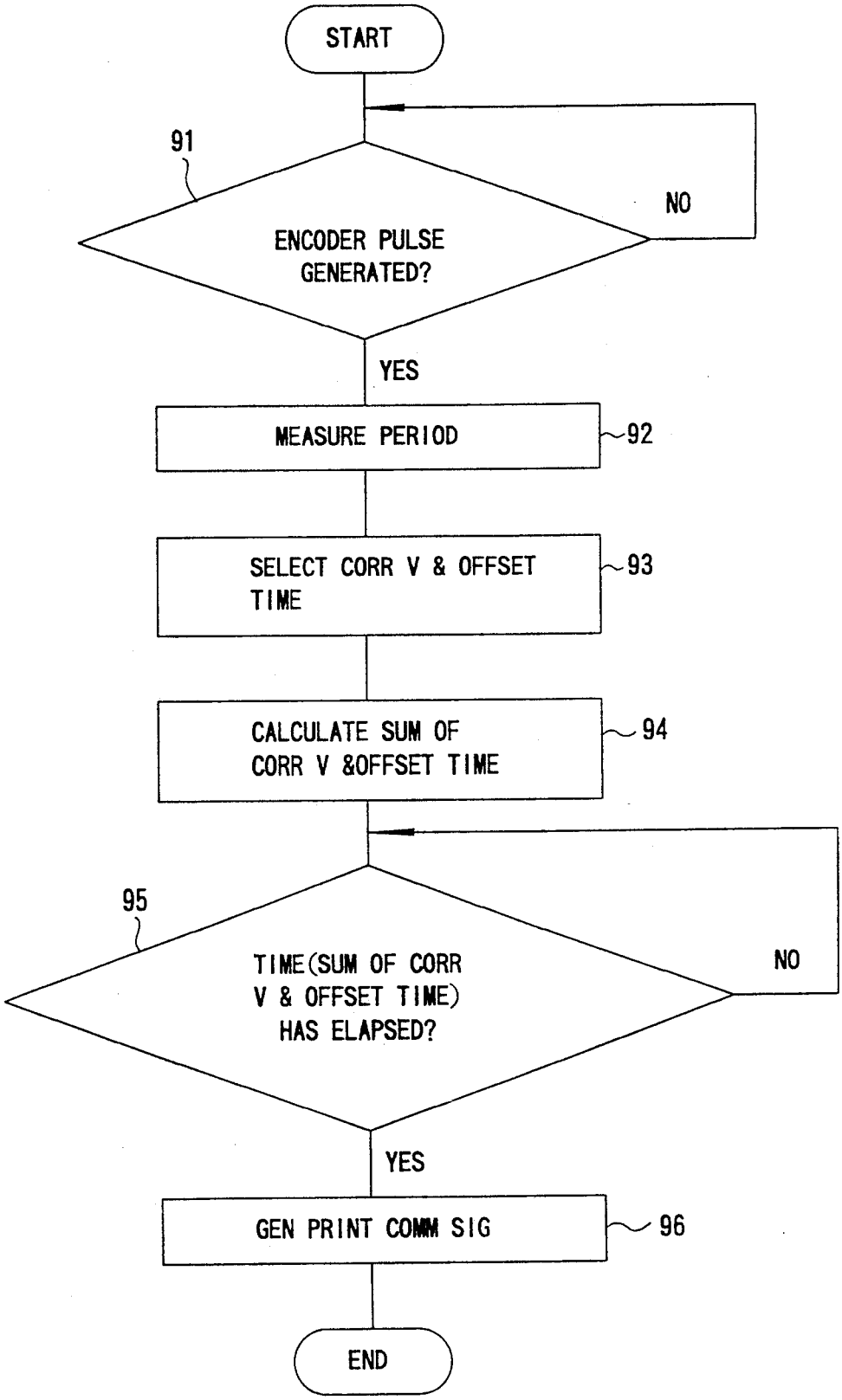
FIG. 11 is a flowchart for assistance in explaining the operation of the third embodiment of the present invention.

A third embodiment of the present invention will be described hereinbelow with reference to FIGS. 7 and 11. FIG. 11 is a flowchart showing the operation of the third embodiment, and Table 3 is a correction value table used for this third embodiment.

TABLE 3

| PERIOD T | TORG ACCEL | TORG DECEL | Tos |
|---|---|---|---|
| t0 | tdACC0 | tdBRK0 | to0 |
| t1 | tdACC1 | tdBRK1 | to1 |
| t2 | tdACC2 | tdBRK2 | to2 |
| . | . | . | . |
| . | . | . | . |
| tn − 1 | tdACCn − 1 | tdBRKn − 1 | ton − 1 |
| tn | tdACCn | tdBRKn | ton |
| tn + 1 | tdACCn + 1 | tdBRKn + 1 | ton + 1 |
| . | . | . | . |
| . | . | . | . |

When the belt 10 is contracted during deceleration, the correction value corresponding to the expansion and contraction of the belt 10 becomes negative. Therefore, if the contraction rate of the belt 10 during deceleration is large, there exists the case where the sum total of the negative correction value for the belt expansion and contraction and the correction value for the flight time becomes eventually a negative value. This negative correction value indicates that the printing command signal 301 must be generated before the encoder pulse signal 501 is generated, which is practically impossible. To overcome this problem, therefore, in this embodiment, an offset time Tos having a value proportional to the inverse number of the speed is introduced in order that the correction table can be constructed in such a way that the total time of the offset time Tos and the correction time TORG becomes always positive. Further, TORG corresponds to Tdly in Table 2.

In this embodiment, after the generation of the encoder pulse signal EPn has been confirmed (in step 91) in FIG. 11, the period between the preceding encoder pulse signal EPn−1 and the current encoder pulse signal EPn is measured (in step 92), and the correction value TORG corresponding to the period T and the offset value Tos are selected from the Table 3 in the ROM 9. For instance, if the period T during acceleration is tn as shown in FIG. 7, the correction values tdACCn and ton are selected as TORG and Tos, respectively (in step 93).

Thereafter, the total correction value Tdly is obtained as (in step 94)

$$Tdly = TORG + Tos$$

Here, if the period T is tn, $$Tdly = tdACCn + ton$$

Further, when the total correction time Tdly has elapsed after the encoder pulse signal EPn was generated (in step 95), the printing command signal FPn is generated (in step 96).

In this embodiment, since the correction value is always kept at a positive value by introducing the offset value Tos, the correction can be made even if the belt contraction rate during deceleration is large.

In the above-mentioned embodiment, the correction is executed on the assumption that one printing command signal is generated for each encoder pulse signal. However, where the encoder pulse signal is divided or multiplied in frequency, the correction is executed for the divided or multiplied output signal.

As described above, since the printing command signal can be corrected in such a way that both the influences of flight time and belt expansion and contraction can be eliminated, the printing dot intervals can be kept constant at all the times, thus realizing a high speed printing under excellent printing quality such that the printing operation can be effected even when the carriage is being accelerated or decelerated.

On the other hand, in order to improve the reliability of the printing timing correction related to the belt expansion and contraction, it is preferable to adopt a special pattern as the carriage speed pattern. This pattern will be described hereinbelow with reference to FIGS. 12 and 14.

Figure 12:
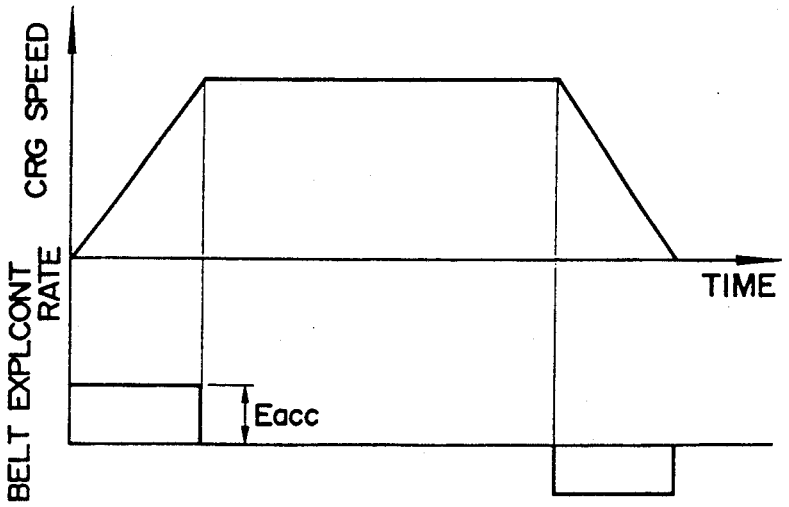
FIG. 12 is a timing chart showing the relationship between the general carriage speed pattern and the belt expansion and contraction rate.

FIG. 12 shows the relationship between the speed pattern of the carriage 12 and the belt expansion and contraction when printing data for one line are printed. In general, a trapezoidal pattern as shown in FIG. 12 has conventionally been adopted. In this case, since the acceleration and deceleration are both a uniformly accelerated motion, the belt expansion and contraction conditions are as follows:

* During acceleration, the belt is expanded at a constant rate proportional to the acceleration rate;
* During constant speed, the belt expansion rate is roughly zero; and
* During deceleration, the belt is contracted at a constant rate proportional to the deceleration rate.

Where the correction is executed according to the belt expansion and contraction conditions of the above-mentioned speed pattern, there arises a problem when the acceleration changes to the constant speed or when the constant speed changes to the deceleration. Here, for simplification, only the correction according to the belt expansion and contraction when the acceleration changes to the constant speed will be taken into account.

Figure 13:
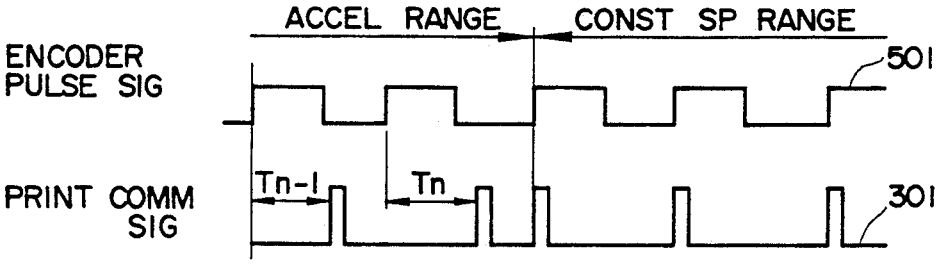
FIG. 13 is a timing chart showing the relationship between the encoder pulse signal and the printing command signal in the speed pattern shown in FIG. 12.

In the belt expansion and contraction conditions shown in FIG. 12, since the belt expansion rate changes abruptly from $E_{acc}$ to zero the instant the acceleration changes to the constant speed, the correction rate also changes from Tn to zero as shown in FIG. 13. Therefore, the intervals between the printing command signals 301 becomes extremely short, in comparison with the succeeding and preceding intervals, beyond the ordinary response speed of the printing head, so that there exists a problem in that the printing is disabled.

Figure 14:
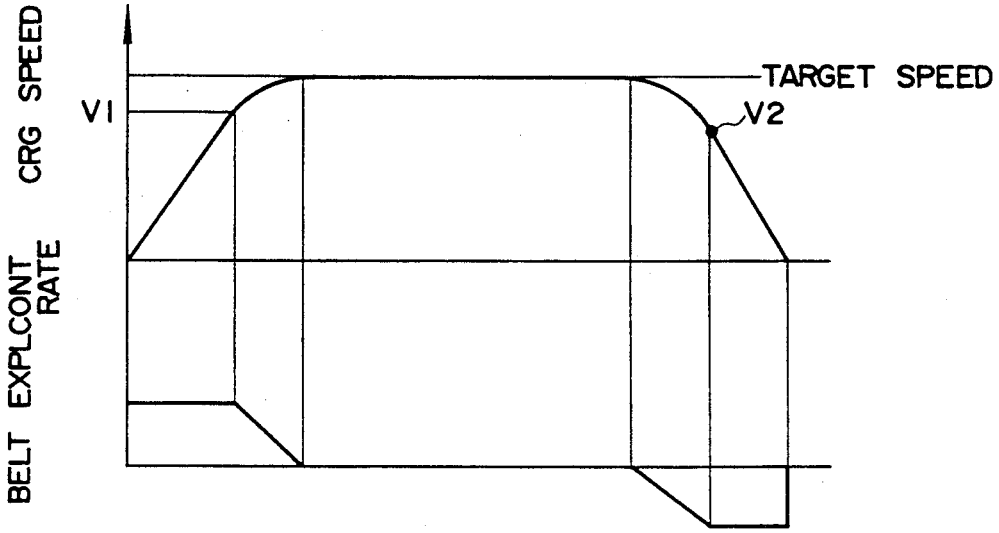
FIG. 14 is a timing chart showing the relationship between the desirable carriage speed pattern and the belt expansion and contraction rate.

To overcome this problem, as shown in FIG. 14, the motor speed is controlled so as to be smoothly changed from a predetermined speed $V_1$ to a target speed; that is, the motor speed is controlled in such a way that the acceleration or the belt expansion rate decreases gradually (e.g. in proportion to the difference between the current speed and the target speed). By controlling the motor speed, it is possible t prevent the time intervals of the printing command signal 301 from being reduced extremely.

On the other hand, during deceleration, the motor speed is controlled in such a way that the deceleration or the belt contraction rate increases gradually (e.g. in proportion to the difference between the current speed and the target speed).

The present invention is not limited to only the above-mentioned embodiments, various modifications of the present invention may be made without departing from the gist thereof.

What is claimed is:

1. A printing control system in which a printing head is moved by a pulling member coupled to a power source, and a printing command signal generated in response to a signal synchronized with motion of the power source is applied to the printing head, which comprises:

means for detecting moving speed of the printing head; and means for correcting timing at which the printing command signal is generated, in association with both expansion and contraction rate of the pulling member and flight time at the detected moving speed, said timing correcting means further comprising:

a) means for generating a time correction value including an addition of a first correction time for correcting the generation timing of the printing command signal with respect to the expansion and contraction rate of the pulling member and a second correction time for correcting the generation timing of the printing command signal with respect to the flight time, both according to the detected moving speed, in accordance with a predetermined relationship between the first correction time and the moving speed of the printing head and another predetermined relationship between the second correction time and the moving speed of the printing head;

b) means for controlling time intervals from when the synchronizing signal is received to when the printing command signal is generated, on the basis of the generated time correction value, and c) means for discriminating whether the printing head is being accelerated or decelerated; and wherein said correction value generating means generates different values as the correction value according to acceleration and deceleration discriminated by said discriminating means, even if the detected moving speed is the same.

2. The printing control system of claim 1, wherein said correction value generating means decide an offset time corresponding to the detected moving speed in accordance with a predetermined inversely proportional relationship between the correction time and the detected moving speed; and the decided offset time is also included in the generated time correction value so that the generated time correction value becomes always a positive value, irrespective of that the printing head is being accelerated or decelerated.

* * * * *